US006845064B2

(12) United States Patent
Hildebrandt

(10) Patent No.: US 6,845,064 B2
(45) Date of Patent: Jan. 18, 2005

(54) ADD-ON MEDICINE DISPENSER TIMER

(76) Inventor: William K. Hildebrandt, 165 Weaver Rd., Inman, SC (US) 29349

( * ) Notice: Subject to any disclaimer, the term of this patent is extended or adjusted under 35 U.S.C. 154(b) by 366 days.

(21) Appl. No.: 10/124,664

(22) Filed: Apr. 17, 2002

(65) Prior Publication Data

US 2003/0198134 A1 Oct. 23, 2003

(51) Int. Cl.[7] ..... G04B 47/00; B65D 51/16; G07F 11/00

(52) U.S. Cl. ..... 368/10; 215/228; 215/230; 221/2; 221/15

(58) Field of Search ..... 215/200, 228; 228/230, 231; 368/10, 107–110; 221/2, 3, 215; 340/309.15, 309.16, 309.8, 309.9

(56) References Cited

U.S. PATENT DOCUMENTS

| | | | | |
|---|---|---|---|---|
| 4,419,016 A | | 12/1983 | Zoltan | 368/10 |
| 4,849,948 A | * | 7/1989 | Davis et al. | 368/10 |
| 4,939,705 A | * | 7/1990 | Hamilton et al. | 368/10 |
| 5,233,571 A | | 8/1993 | Wirtschafter | 368/10 |
| 5,625,334 A | | 4/1997 | Compton | 340/309.15 |
| 5,751,660 A | | 5/1998 | Chappell | 368/10 |
| 5,751,661 A | | 5/1998 | Walters | 368/10 |
| 5,852,590 A | | 12/1998 | de la Huerga | 368/10 |
| 6,324,123 B1 | * | 11/2001 | Durso | 368/10 |
| 6,633,796 B1 | * | 10/2003 | Pool et al. | 700/231 |
| 6,710,703 B2 | * | 3/2004 | Huang | 340/309.16 |

* cited by examiner

*Primary Examiner*—Vit W. Miska
(74) *Attorney, Agent, or Firm*—McNair Law Firm, P.A.

(57) ABSTRACT

An improved device for timely medication administration that attaches to any original container cap and that measures and displays elapsed time in response to opening or closing of said original container cap is disclosed. Physical, chemical and labeled characteristics of the original medication vessel are thus preserved as dispensed. This device includes a timing unit, a compression reset switch and a thermoplastic housing for the above with a resilient, flexible, circumferential wall that permits operation of the enclosed compression reset switch. The thermoplastic housing also features a rigid lower lip that allows adhesive attachment to the original lid.

13 Claims, 4 Drawing Sheets

ADD-ON MEDICINE DISPENSER TIMER

BACKGROUND OF THE INVENTION

The present invention relates generally to timer devices for medicine dispensers which provide a correct time that a dosage needs to be taken by an individual, and more particularly to a medicine dispenser timer which can be added to an existing medical vial, such as a prescription vial or bottle as originally filled by a pharmacy, or an original non-prescription medicine container, wherein the timer is activated by opening or closing the medicine vial and displays an indication of the next correct dosage on the medicine container cap.

Medication administration errors are well documented in pharmacy and medical literature. Many administration errors are due to inappropriate time intervals of given doses. The result is either overdosing and toxicity, or under dosing causing a sub-therapeutic drug blood level. There are solutions to this dosage interval problem in prior art, but with several problems. These problems are divided into four general areas.

First are the devices that require redistribution of medication from the original container, as dispensed from the pharmacy, distributor, or manufacturer. These devices may result in errors during redistribution, loss of original labeling, and loss of physical and chemical properties protected in the original container.

Second, many devices replace the original container lid. This again may alter the physical and chemical properties of the original container. Replacement of the original container lid also necessitates the device be manufactured in a vast array of configurations and sizes to be useful with the large variety of containers currently in the marketplace.

Third, liquid dosage forms present problems for current devices as the closures are different than those found on containers of solid dosage forms. Liquid dosage forms cannot readily be redistributed into compartmental type devices.

Fourth, many devices and systems require programming or record keeping. Programming can be difficult for patients who are disabled or elderly. Multiple medications can complicate programming requirements and multiple caregivers can add to problems with devices that are difficult to use.

Examples of the above prior art devices are shown in U.S. Pat. Nos. 4,419,016, 4,939,705, 5,233,571, and 5,751,660, as well as the exemplary prior devices described therein. U.S. Pat. No. 4,419,016 discloses a device for indicating last mediation usage which includes a container with a screw on cap which uses a compression switch to indicate the time when the container was last opened to remove a dosage of medication or to display the time elapsed since the cap was last taken off of the container. The cap is said to fit standard vials or containers. Variations of a compression switch are disclosed, such as a pliable extension which is inserted between the cap threads and the bottle neck threads so that as the cap is threaded on the neck, the pliable extension is compressed and contacts within the extension are actuated. U.S. Pat. No. 4,939,705 discloses a container and cap combination wherein a timing device in the cap measures a time interval between when a cap is removed and when the cap is reinstalled to determine a true medical dose access event and distinguish them from false events. In addition, the dispensing container would require redistribution of medicine from the original containers presently used by pharmacies. U.S. Pat. No. 5,233,571 discloses a medication timer having a timing-alarm unit activated by a compression switch which also requires the manufacture of a special medicine cap which would have to replace the standard pharmaceutical cap containers used by pharmacies, or would require a new cap/container combination and redistribution of the medication from the original container. U.S. Pat. No. 5,751,660 discloses a base timer device to which a typical pharmaceutical cap and vial may be attached. The vial may be removed from the base and discarded when empty. The base includes a push button that needs to be actuated by a patient to set the time at which the medication was taken. There appears not to be any correlation between the cap opening and the actuation of the push button so that reliability is compromised.

The goals of the present invention are therefore to provide a device for the timely administration of medication that does not require the redistribution of medications from the original container and does not require replacement of the original container lid. The device should be compatible with all types of child safety and other security closures found on both solid and liquid dosage forms of both prescription and over-the-counter medications. Additionally, the device should be simple to use and not require programming or initial set-up, other than the affixation to an existing container lid. Further goals are to provide a device that is compact, inexpensive to manufacture, and reliable.

SUMMARY OF THE INVENTION

The above objectives are provided by an add-on medicine dispensing timer which can be affixed to an original medicine vial containing a solid or liquid medicine and having a closure cap. The dispensing timer includes a timer housing having an upper wall; a circumferential wall integral with the upper wall, and a lower attachment surface extending from the circumferential housing wall generally parallel to the upper wall for attaching to the cap of the medicine vial. A timing mechanism is carried by the housing which is displaceable relative to at least the circumferential housing wall so that downward force on one of the upper wall and timing mechanism causes the timing mechanism to be reset and actuated to indicate the instantaneous time elapsed since the timing mechanism was reset. Preferably, the circumferential wall of the timer housing includes a circumferential wall that flexes when the downward force is exerted upon the upper wall of the housing to deflect the timing mechanism downward so that the compression switch is engaged by one of the vial cap and lower attachment surface of the housing whereby the timing mechanism is reset and actuated. Advantageously, the lower attachment surface may include a circumferential attachment lip which extends inwardly toward but terminates short of the timing mechanism. The attachment lip is constructed and arranged for attachment to the vial cap whereby the compression switch engages the vial cap to be reset and actuated. The flexible, circumferential wall may include a first wall portion and a second wall portion, the first and second wall portions flexing about a flex point or line so that the upper wall and timing mechanism are displaced downwardly toward the vial cap when pressed when manually removing or replacing the cap. In the case of a typical safety cap, the cap is pushed downward to remove the cap and the timing mechanism is reset. In the case of a non-safety cap, the cap is usually snapped or screwed on with a downward force when the cap is replaced resetting the timing mechanism.

An adhesive layer may be carried by the attachment lip for affixing the attachment lip to the vial cap. The upper wall of the housing includes a retention aperture in which the timing mechanism is pressed and retained. The timing mechanism includes a digital readout seen through the aperture for displaying the time since the vial or bottle cap was reset. This device for timely medication administration will be used with the medication container caps commonly found on prescription and over-the-counter medication containers.

To one commercial form, the device may be generally a chronometer that indicates the length of time the lid has been in place on the medication vessel. The downward pressure of opening or closing the lid acts as the start button on a stopwatch. The digital readout indicates elapsed hours and minutes of lid closure. Simple inspection of the readout allows the consumer to make an informed decision as to whether or not an additional dose of medication is appropriate according to labeled instructions. The device is electrically powered from a battery source.

A primary feature of the invention is that medications require no redistribution from the original dispensing container. The device can be manufactured in several sizes to be used with the lids of common medication vessels, including liquids.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
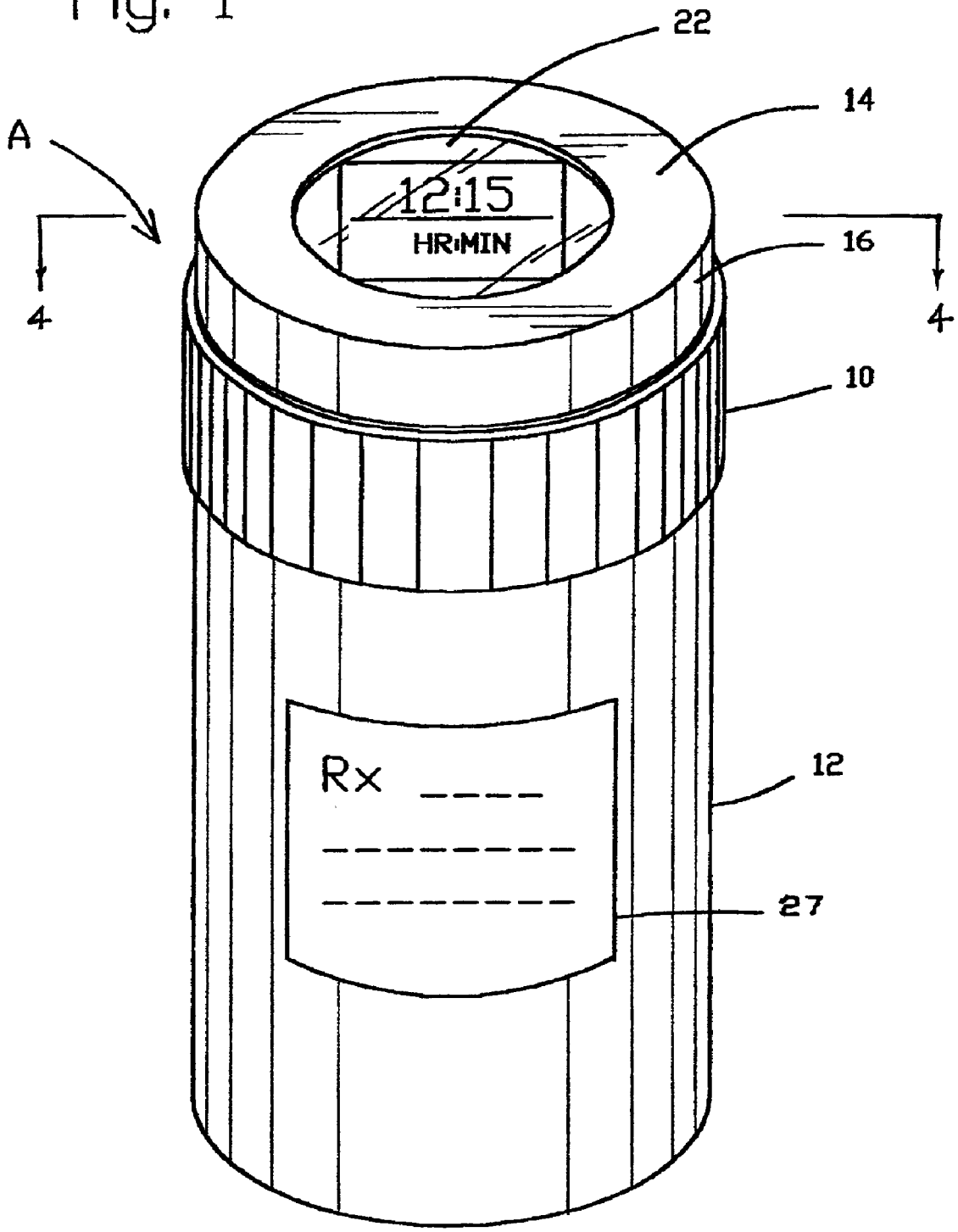
FIG. 1 is a perspective view of a standard pharmaceutical medicine vial incorporating an add-on medicine dispensing timer according to the invention.

Referring now to the drawings, the invention will now be described in more detail.

As can best be seen in FIG. 1, an add-on medicine dispensing timer, designated generally as A, is illustrated as affixed to a standard vial cap 10 of a standard pharmaceutical medicine vial 12 containing a solid or liquid medicine. Since the construction and features of the present invention do not depend on the type of medicine vial, bottle, or other container, prescription or non-prescription, with which the invention may be used, only so much of a cap and vial will be described as is necessary to an understanding of the present invention. Typically, medicine vials with child safety features require that the cap be pushed down on the top of the vial before the cap can be rotated. Medicine vials without child safety features require that the cap be pushed down to close the vial. The present invention is intended to be used with any medicine vial and cap which require downward force on the cap in order to open or close the vial. It being understood, of course, that the term "vial" is used to mean any container having a cap requiring compression to open or close the container.

Figure 2:
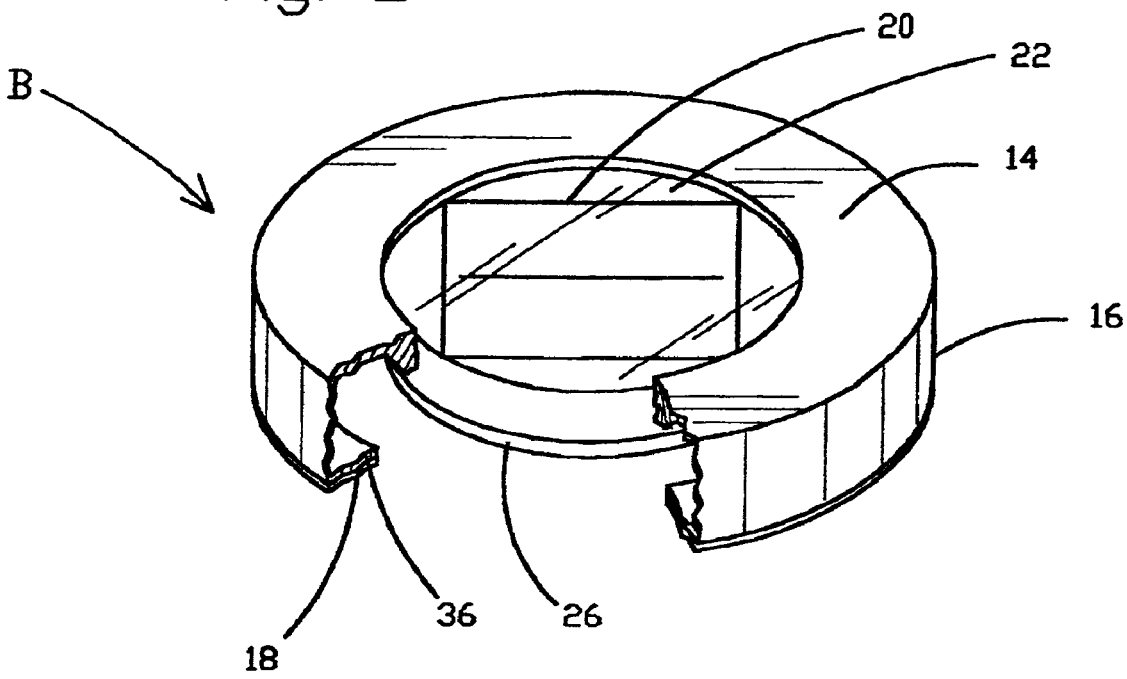
FIG. 2 is a perspective view of an add-on medicine dispensing timer constructed according to the invention with parts cut away.
Figure 3:
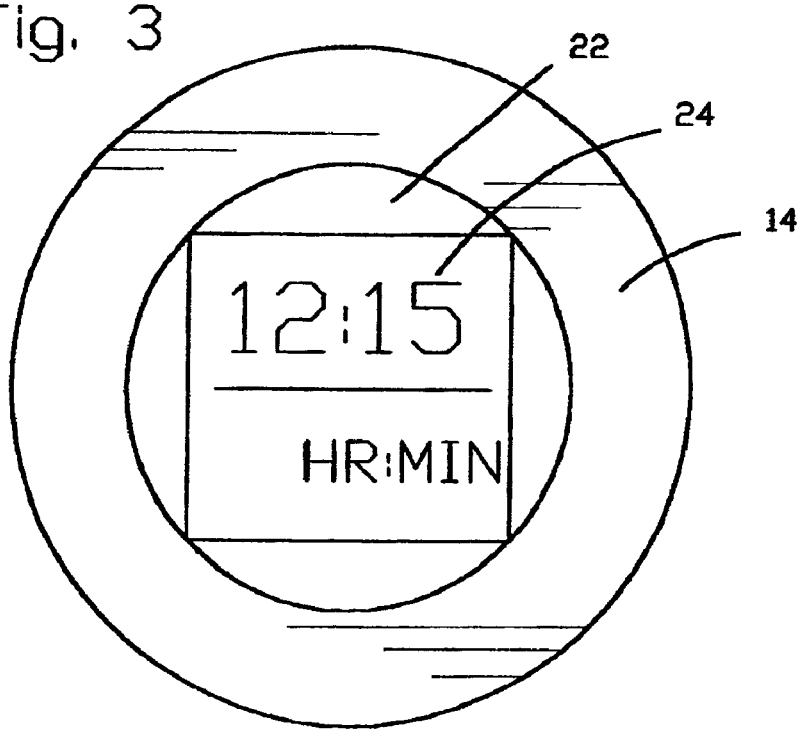
FIG. 3 is a top plan view of the add-on medicine dispensing timer of the present invention.
Figure 4:
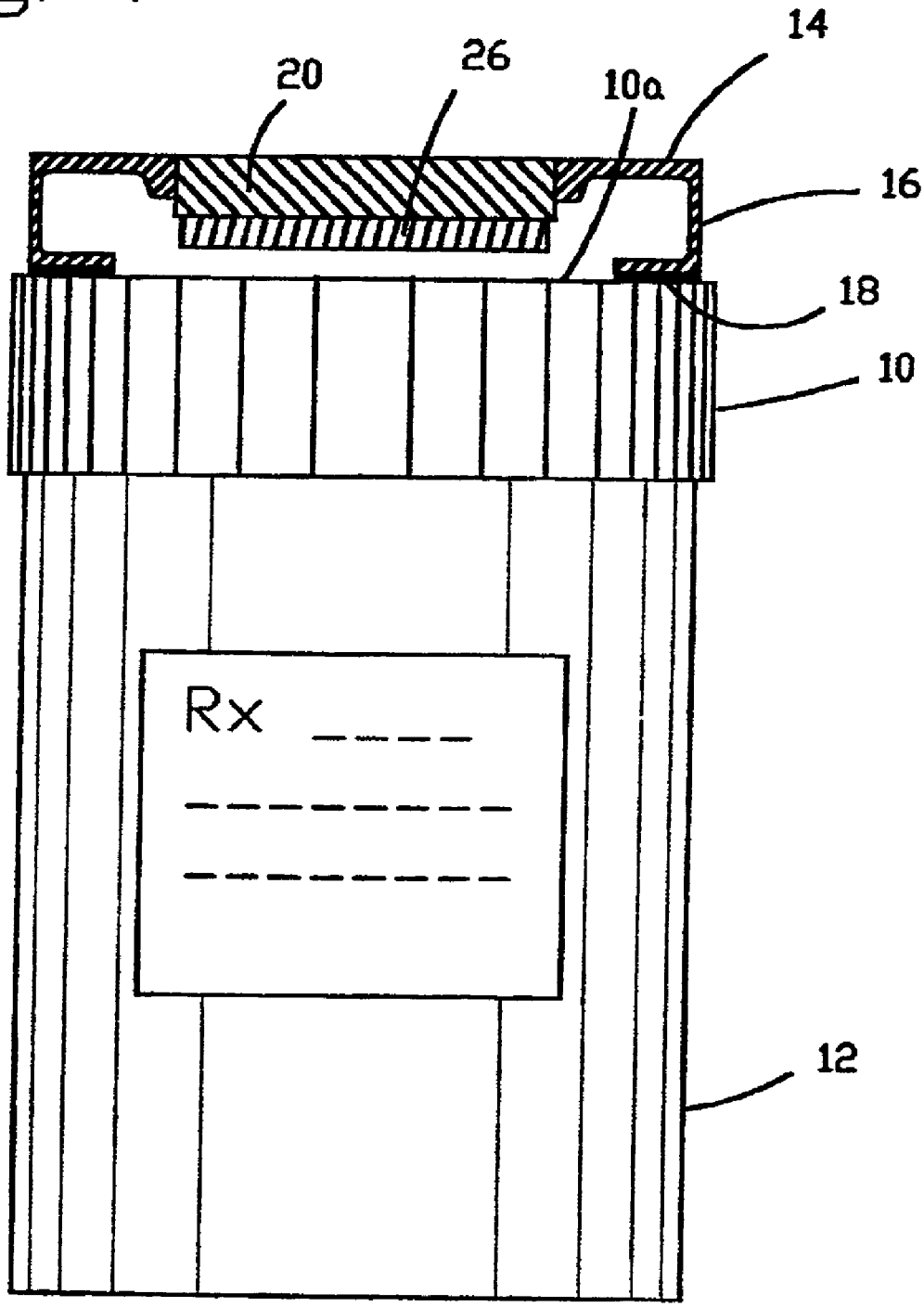
FIG. 4 is a front elevation illustrating a standard pharmaceutical medicine vial and cap with a medicine dispensing timer fixed to the vial cap according to the invention shown in cross-section taken along line 4—4 of FIG. 1 and wherein the timer is in a non-compressed, non-actuated position.
Figure 5:
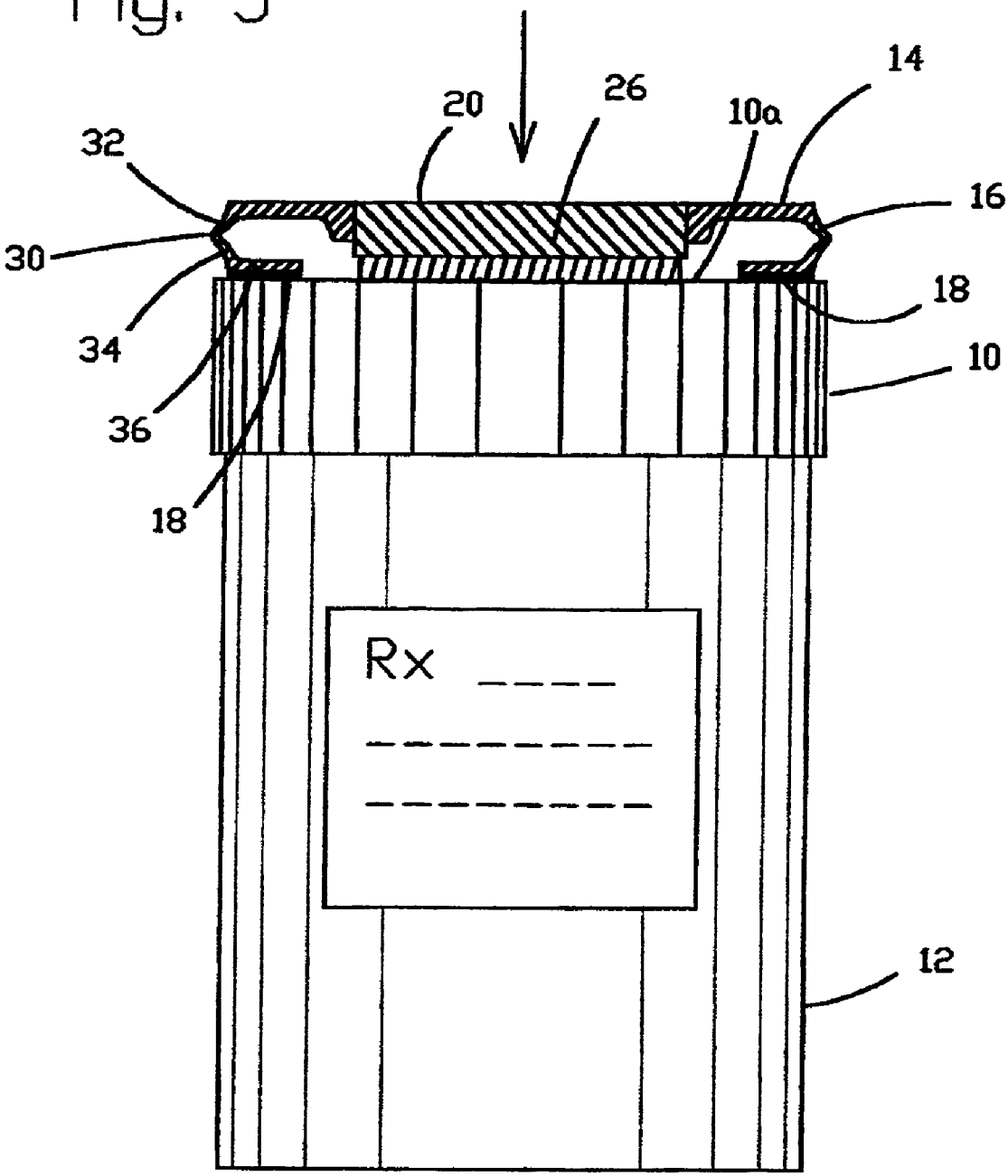
FIG. 5 is a front elevation of a standard pharmaceutical medicine vial and cap having a medicine dispensing timer affixed to the vial cap according to the invention shown in cross-section taken along line 4—4 of FIG. 1 wherein the medicine timer device is in a compressed actuated position for resetting the timing device.

As can best be seen in FIGS. 2 and 3, medicine dispensing timer A includes a timer housing, designated generally as B, preferably formed from a suitable thermoplastic. Timer housing B has a generally rigid upper wall 14 and a generally flexible circumferential sidewall 16 which terminates in a generally rigid attachment lip 18 which affixes to a top surface 10*a* of vial cap 10 (FIG. 5). Upper wall 14 of housing B includes a retention aperture 20 for retaining a timing mechanism 22 which is pressed into the aperture and forms an integral part of medicine dispensing timer A when affixed to vial cap 10. Timing mechanism 22 may be any suitable timing mechanism and includes a battery power source. Suitable timing mechanism are disclosed and discussed in U.S. Pat. No. 5,233,571, incorporated in this disclosure by reference. Preferably, the timing mechanism is a simple chronometer that indicates the length of time which has lapsed since when the cap was replaced on the medicine vial after removal for a dosage, without or with an alarm. The mechanism includes a compression switch 26 actuated by the downward pressure on vial cap 10, when opening and closing, to act as a start button on a stopwatch. The mechanism is equipped with a digital readout 24 indicating elapsed time, such as hours and minutes, of cap closure (FIG. 3). A simple inspection of the readout face allows the consumer to make an informed decision as to whether or not a dose of medication is required according to the pharmacy label instructions 27. As can best be seen in FIGS. 4 and 5, a compression switch 26 of timing mechanism 22 may be provided on the bottom of the timing mechanism so that the compression switch is actuated by a downward force and compression of housing B. For this purpose, circumferential wall 16 of housing B may be constructed as a resilient, flexible, circumferential wall that deform outwardly when downward force is applied to the upper wall 14, as indicated in FIG. 5. Flexible, circumferential wall 16 may include a flex line 30 about which the wall flexes so that a first wall portion 32 and a second wall portion 34 are made to be inclined with respect to one another rather than co-parallel. Resilient, flexible, circumferential wall 16 is in a non-compressed state in FIG. 4. Means for affixing housing B to vial cap 10 may include a circumferential adhesive strip or adhesive layer 36 carried by attachment lip 18 of housing B. Other suitable means for affixing the timer housing to the vial cap may also be utilized. For example, a compressible housing constructed from a cellular foam material, such as neoprene, may be used. In this case, the compressible housing may be washer shaped with the timing mechanism embedded therein or thereon. For purpose of the above illustrated construction upper wall 14 may be rigid, attachment lip 18 may be rigid, and circumferential wall 16 may be flexible so that downward force on upper surface 14, or the timing mechanism, causes timing mechanism 22 to move downward so that compression switch 26 engages upper surface 10*a* of cap 10. When compression switch 26 is actuated, the timer is reset either on opening or closing, or both. Whether the timer is reset upon opening or closing, the display will effectively indicate the time elapsed since cap closure and last dosage of the medicine. While medicine dispensing timer A is shown affixed on a tablet or other dry medicine vial, it is understood, of course, that the timer can also be used on original liquid medicine containers and vials. For that purpose, timer housing B may be made in various sizes to fit on various caps of original medicine containers and vials.

Thus, it can be seen that an advantageous construction can be had according to the invention for a medicine dispensing timer which can be added to any original medicine container with the original dosage instruction attached. The timing mechanism, such as a chronometer, is reset by the downward pressure required to either open or close the lid. In the case of a child safety cap the reset occurs upon opening. In the case of a non-child safety cap the reset occurs upon closure. Visual inspection of the display indicates proper reset of the device. In the event that opening or closing has not resulted in proper reset of the device, the device can be reset by downward pressure until the display has been reset to zero. In this case, the device resets at a time close enough in proximity to the administration of the removed dose of medication that the displayed time will be useful in determining if the next dose of medication is indicated according to labeled instruction.

While a preferred embodiment of the invention has been described using specific terms, such description is for illustrative purposes only, and it is to be understood that changes and variations may be made without departing from the spirit or scope of the following claims.

What is claimed is:

1. An add-on medicine dispensing timer which can be affixed to an original medicine vial having a closure cap comprising:

a timer housing having an upper wall;

a circumferential wall integral with said upper wall;

a lower attachment surface having an attachment lip extending inwardly from said circumferential wall a distance less than said first diameter and generally parallel to said upper wall for attaching to the cap of the medicine vial; and a timing mechanism carried by said housing and being displaceable relative to at least said circumferential housing wall so that downward force on one of said upper wall and timing mechanism causes said timing mechanism to be reset and actuated to indicate the instantaneous time elapsed since said timing mechanism was reset.

2. The device of claim 1 in which said upper wall of said timer housing carries said timing mechanism and said circumferential wall flexes wherein when said downward force is exerted upon said upper wall of said housing said timing mechanism is deflected downward so that said compression switch is engaged by one of said vial cap and lower attachment surface of said housing whereby said timing mechanism is reset and actuated.

3. The device of claim 1 wherein said attachment lip of said lower attachment surface extends inwardly toward but terminates short of said timing mechanism; said attachment lip being constructed and arranged for attachment to said vial cap whereby said compression switch engages said vial cap to be reset and actuated.

4. The device of claim 1 including an adhesive layer carried by said attachment lip for affixing said attachment lip to said vial cap.

5. The device of claim 2 wherein said flexible, circumferential wall includes a first wall portion and a second wall portion, said first and second wall portions flexing about a flex line so that said upper wall and timing mechanism are displaced downwardly in the direction of said vial cap when pressed upon manually to remove or replace the cap.

6. The device of claim 1 wherein said upper wall of said housing includes a retention aperture in which said timing mechanism is pressed and retained, and said timing mechanism includes a digital readout seen through said aperture for displaying the time since said vial cap was reset.

7. An add-on medicine dispensing timer for use with an original medicine vial in which dry or liquid medicine was dispensed or sold to a consumer, said add-on medicine dispensing timer comprising:

a timer housing having an upper wall and a circumferential side wall integral with said upper wall said circumferential side having first and second wall portion interconnected with a flex line;

a timing mechanism having a display for indicating an appropriate time for a medicine dose carried by said housing;

an attachment element carried by said housing for attaching said timer housing to said closure cap; and said timer mechanism including a motion switch which detects downward movement of said timing mechanism relative to said timer housing wherein when down force is applied to one of said timer upper wall and timer mechanism in response to one of removing and replacing said closure cap.

8. The device of claim 7 wherein said upper wall of said housing includes a retention aperture in which said timing mechanism is pressed and retained, and said timing mechanism includes a digital readout seen through said aperture for displaying the time since said vial cap was reset.

9. An add-on medicine dispensing timer which can be affixed to an original medicine vial having a closure cap comprising:

a timer housing having an upper wall;

a flexible circumferential wall integral with said upper wall;

an attachment mount for attaching said timer housing to the said closure cap of the medicine vial; and a timing mechanism carried by said upper wall of said housing in a displaceable manner so that downward force on one of said upper wall and timing mechanism causes said flexible circumferential wall to flex causing said timing mechanism to engage by a stationary surface to be reset and actuated to indicate the instantaneous time elapsed since said timing mechanism was reset.

10. The device of claim 9 wherein said timer mechanism includes a compression switch, said compression switch being engaged by said vial cap when said downward force is exerted upon said upper wall of said housing deflecting said timing mechanism downward resetting and activating said timing mechanism.

11. The device, of claim 9 wherein said attachment mount includes a circumferential attachment lip constructed and arranged for attachment to said closure cap and an adhesive layer carried by said attachment lip for affixing said attachment lip to said vial cap.

12. The device of claim 9 wherein said flexible, circumferential wall includes a first wall portion and a second wall portion, said first and second wail portions flexing about a flex line so that said upper wall and timing mechanism are displaced downwardly in the direction of said closure cap when pressed upon manually to remove or replace the cap.

13. The device of claim 9 wherein said upper wall of said housing includes a retention aperture in which said timing mechanism is pressed and retained, and said timing mechanism includes a digital readout seen through said aperture for displaying the time since said vial cap was reset.

* * * * *